US005990599A

United States Patent [19]

Jackson et al.

[11] Patent Number: 5,990,599

[45] Date of Patent: Nov. 23, 1999

[54] HIGH-PRESSURE DISCHARGE LAMP HAVING UV RADIATION SOURCE FOR ENHANCING IGNITION

[75] Inventors: Andrew D. Jackson, Hammondsport; Alleppey V. Hariharan; Randy J. Robinson, both of Bath; Albert E. Kowal; John Alderman, both of Painted Post, all of N.Y.

[73] Assignee: Philips Electronics North America Corp., New York, N.Y.

[21] Appl. No.: 08/993,953

[22] Filed: Dec. 18, 1997

[51] Int. Cl.[6] ..... H01J 61/12; H01J 61/34; H05B 41/14

[52] U.S. Cl. ..... 313/25; 313/643; 313/595; 313/623

[58] Field of Search ..... 313/25, 601, 634, 313/635, 636, 638, 3, 249, 268, 285, 571, 576, 584, 623, 595; 315/267, 160, 158, 71, 73, 248, 344, 59, 60

[56] References Cited

U.S. PATENT DOCUMENTS

| | | | |
|---|---|---|---|
| 4,721,888 | 1/1988 | Proud et al. | 315/60 |
| 4,812,714 | 3/1989 | Keeffe et al. | 315/60 |
| 4,818,915 | 4/1989 | Zaslavsky et al. | 315/60 |
| 4,949,003 | 8/1990 | Cox et al. | 313/26 |
| 5,563,474 | 10/1996 | Wessels et al. | 315/248 |

OTHER PUBLICATIONS

"Improved Starting of the 100–W Metal Halide Lamp", by Gregory Zaslavsky, Sheppard Cohen and William Keeffe, Journal of the Illuminating Engineering Society, Summer 1990, pp. 76–83.

"Enhanced Starting of HID Lamps", by W.W. Byszewski and A.B. Budinger, Journal of the Illuminating Engineering Society, Summer 1990, pp. 70–75.

*Primary Examiner*—Nimeshkumar D. Patel
*Assistant Examiner*—Joseph Williams
*Attorney, Agent, or Firm*—F. Brice Faller

[57] ABSTRACT

HID lamp has a U-enhancer connected between first and second leads for an arc tube. The UV-enhancer has a quartz envelope containing an electrode connected to the first lead, and is surrounded by a metal ring which is spaced from the envelope by a sleeve of borosilicate glass. The ring is capacitively coupled to the envelope and is electrically connected to the second lead, which may also support the sleeve.

3 Claims, 2 Drawing Sheets

HIGH-PRESSURE DISCHARGE LAMP HAVING UV RADIATION SOURCE FOR ENHANCING IGNITION

BACKGROUND OF THE INVENTION

1. Technical Field

This invention relates to high-pressure discharge lamps having a discharge vessel enclosed by an outer bulb, and more particularly to a metal halide lamp having a starting aid arranged in the intervening space between the outer bulb and the discharge vessel.

2. Description of the Related Art

High pressure discharge lamps, or more particularly metal halide lamps, having starting aids are known in the art. Such lamps are suitable for various applications such as general interior lighting, general exterior lighting, video illumination, etc. The discharge vessel of the known lamp is typically made of quartz glass. Alternatively, this vessel may be made of a ceramic material, herein understood to be a densely sintered polycrystalline metal oxide such as $Al_2O_3$ or YAG or a densely sintered polycrystalline metal nitride such as AlN.

A known problem of metal halide lamps is the comparatively wide spread in ignition time, which arises from a shortage of free electrons due to the presence of electronegative iodine in the lamp filling. Several methods are known in the art to counteract this problem. For example, the addition of a small quantity of $^{85}Kr$ in the discharge vessel can supplement such a shortage. A disadvantage of $^{85}Kr$ as a filling material is its radioactivity.

Alternatively, ignition aids, such as a UV-enhancer, are used in metal halide lamps to promote ignition. A UV-enhancer is typically a small discharge tube positioned adjacent the discharge vessel that acts as an ultraviolet radiation source. Such a UV-enhancer has been disclosed in U.S. Pat. No. 4,818,915 to Zaslavsky et al. This UV-enhancer has an envelope of UV-transmitting quartz material. Upon breakdown, the UV-enhancer will generate UV-radiation at about 253.7 nm or less. The influence of this UV-radiation leads to the production of free electrons in the discharge vessel, which in turn strongly promotes lamp ignition.

Upon application of an ignition pulse supplied by a ballast, UV enhancers capacitively couple energy from one lamp terminal to the other through the UV enhancer gas (or Penning mixture). The UV enhancer must be positioned to provide a minimum gap between the quartz body of the UV enhancer and the opposite potential. This gap reduces arcing through the UV enhancer body which may destroy the UV enhancer itself and the lamp. Furthermore, the orientation between the electrode and emitting plate within the UV enhancer and the opposite potential has an effect on the minimum voltage necessary to create a glow voltage. Thus, for optimum performance, assembly of the lamp requires care in alignment of the UV enhancer's emitting surface with respect to the opposite potential.

Current UV enhancer designs provide no frame support because the enhancers are supported at one end only. Thus, in some lamp types, a separate bridge support structure is necessary.

SUMMARY

A unique high-pressure discharge lamp is disclosed having a discharge vessel containing an ionizable filling and having first and a second electrodes, a base having first and second terminals, and first and second current conductors electrically coupling the first and second electrodes with respective first and second terminals. An outer envelope encloses the discharge vessel and defines an intervening space therebetween. A UV-enhancer is positioned in the space between the outer bulb and the discharge vessel. The UV-enhancer includes, inter alia, an envelope containing an ionizable filling, an electrode sealed in the envelope and electrically coupled to the first current conductor, a conductive ring electrically connected to the second current conductor and capacitatively coupled to the envelope; and an insulating member disposed as a spacer between the conductive ring and the envelope to prevent arcing therebetween. The high pressure discharge lamp is preferably a metal halide lamp with a discharge vessel containing a rare gas, mercury, and a metal halide.

In a preferred embodiment, the conducting member is a metallic ring surrounding the insulating member, which is preferably a cylindrical sleeve fabricated from borosilicate glass.

It is an object of the invention to provide a lamp having a UV-enhancer that produces a glow discharge at a lower minimum voltage.

It is an object of the invention to provide a lamp having a UV-enhancer that provides strucutural support to the lamp assembly.

It is further an object of the invention to provide a lamp having a UV-enhancer that maintain a consistent, optimum separation between the UV-enhancer and the opposite potential to improve ignition characteristics of the lamp and simplify manufacture.

These and other features of the lamp according to the invention will become more readily apparent to those skilled in the art from the following detailed description of the subject disclosure.

BRIEF DESCRIPTION OF THE DRAWINGS

Various embodiments of the subject lamp are explained in more detail with reference to the drawings (not true to scale), wherein.

DETAILED DESCRIPTION OF PREFERRED EMBODIMENTS

Figure 1:
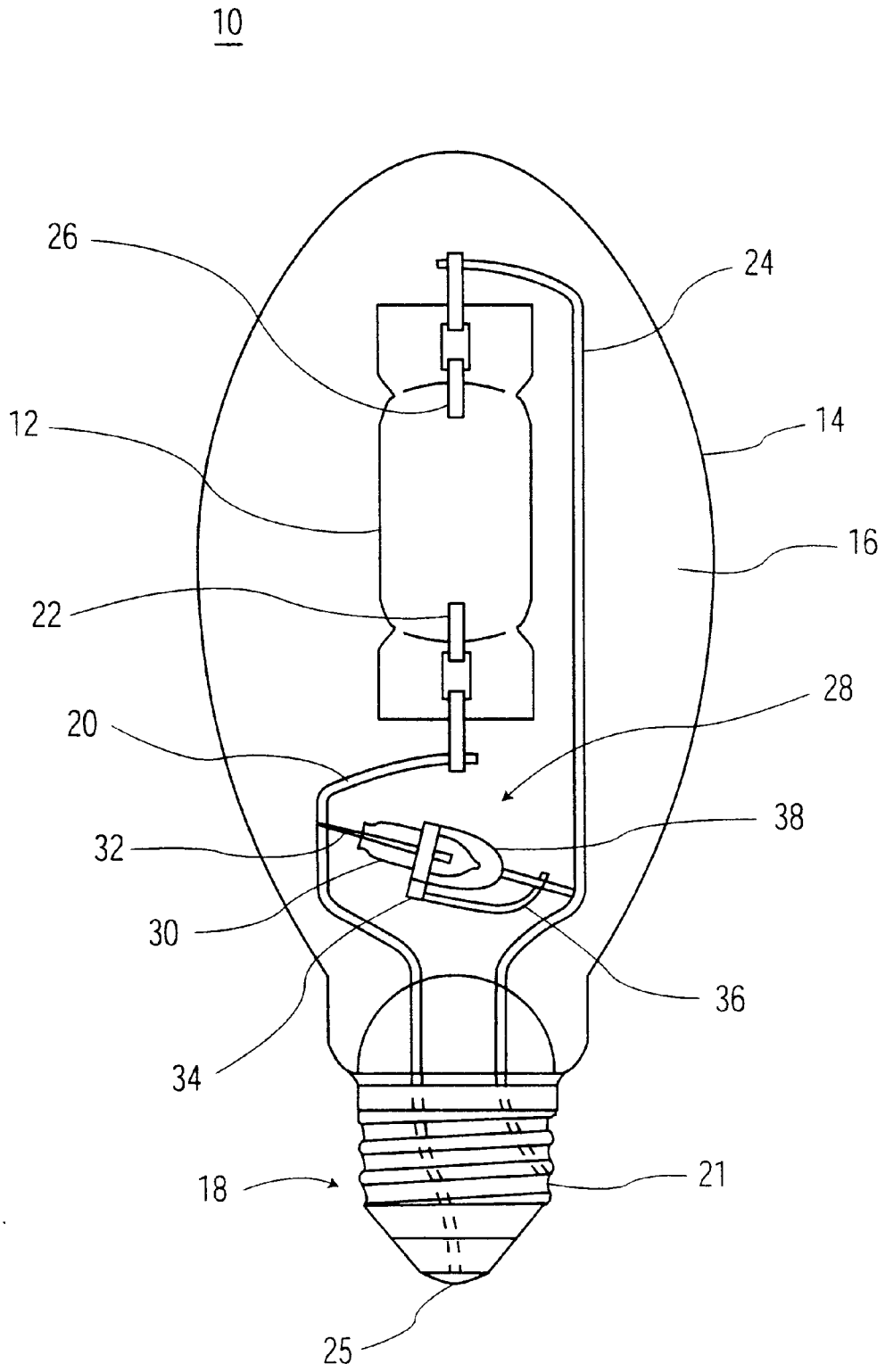
FIG. 1 is a side elevation of a lamp according to the invention.

FIG. 1 illustrates a preferred embodiment of a high-pressure discharge lamp 10. Lamp 10 has a discharge vessel 12 which is enclosed by an outer bulb 14 defining an intervening space 16 therebetween. Discharge vessel 12 contains an ionizable filling such as mercury and metal halides as is well known in the art. Lamp 10 further has a lamp base 18 positioned at an end of outer bulb 14. A first current supply conductor 20 provides an electrical connection between a first terminal 25 in lamp base 18 and internal electrode 22 of discharge vessel 12. Likewise, second current supply conductor 24 provides an electrical connection between a second terminal 21 in lamp base 18 and internal electrode 26 of discharge vessel 12.

UV-enhancer 28 for emitting ultraviolet radiation is connected to the first and second current supply conductors 20 and 24 in the intervening space 16 between. An envelope 30 contains an ionizable filling and emits ultraviolet radiation in the band of 253.7 nm or less to assist ignition of the filling in discharge vessel 12. An electrode 32 is connected at one end to current supply conductor 20, and an intermediate portion is sealed within envelope 30 of UV-enhancer 28. In a preferred embodiment, envelope 30 is constructed of borosilicate glass. A fill material may consist of an inert gas, such as Ar, in combination with a quantity of mercury, such as a Penning mixture. Such an envelope is disclosed in U.S. Pat. No. 4,818,915 to Zaslavsky et al., which is incorporated by reference herein.

Ultraviolet radiation is produced by the ionizable filling in envelope 30 through capacitive coupling of envelope 30 with a conducting member 34 in accordance with the present invention. To promote such ionization, conducting member 34 is positioned adjacent to envelope 30, and is electrically connected to second current conductor 24 by means of connecting wire 36. An ignition pulse is applied to terminals 21 and 25 by an appropriate ballast to initiate ionization within envelope 30. Insulating member 38 is positioned between conducting member 34 and envelope 30. The size and shape of insulating member 38 is selected to maintain a predetermined distance between conducting member 34 and envelope 30 to promote capacitive coupling while preventing destructive arcing therebetween.

The UV-enhancer 28 may be assembled as a unit, i.e. insulating member 38 is fixedly positioned between envelope 30 and conducting member 34. The assembled UW-enhancer 38 may be subsequently positioned with respect to the frame of the lamp without the need for critical alignment procedures that are required under the prior art.

Figure 2:
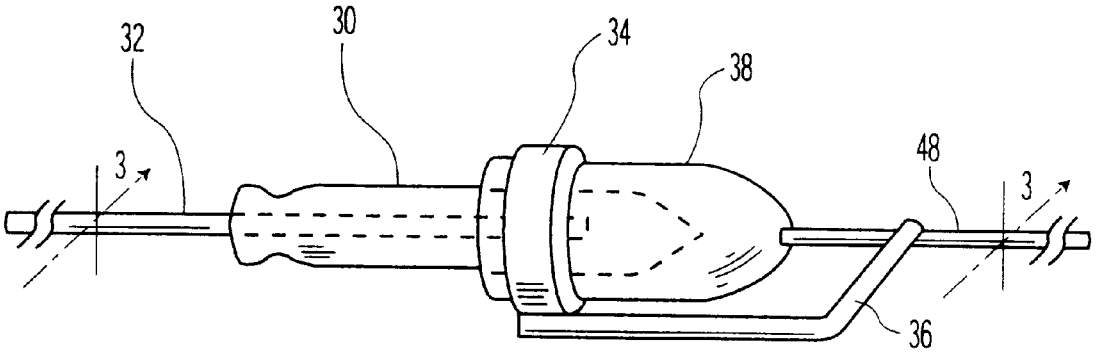
FIG. 2 is a perspective view in enlarged scale of the UV-enhancer according to the invention.
Figure 3:
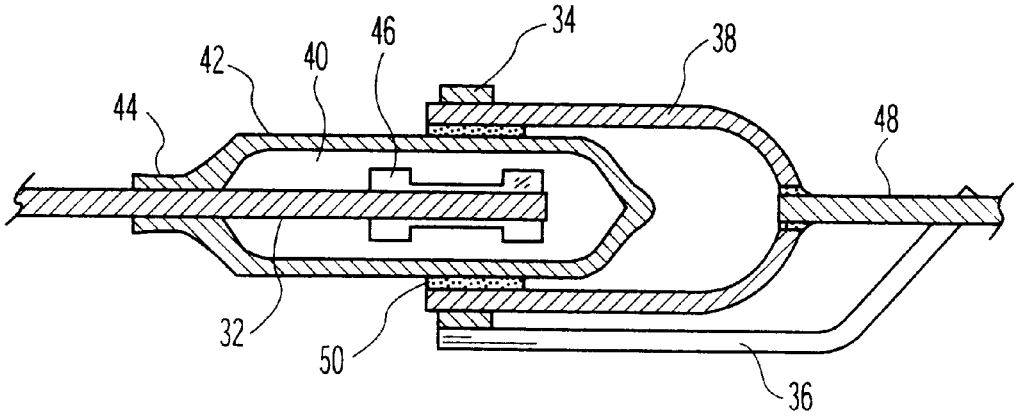
FIG. 3 is a cross-sectional view of the UV-enhancer, taken along lines 3—3 of FIG. 2.

FIGS. 2 and 3 illustrate UV-enhancer 28 in greater detail. Envelope 30 encloses a cavity 40, defining a discharge space, as will be described below. Wall 42 of envelope 30 is preferably made of borosilicate glass or quartz glass. End portion 44 of envelope 30 forms a gas tight seal, around electrode 32. In a preferred embodiment, electrode 32 is fabricated from Kovav wire. It is alternatively contemplated to fabricate electrode 32 as a Mo wire, with a tungsten end within cavity 40. A molybdenum foil (not shown) may be interposed to form the press seal, or a material which matches the thermal expansion characteristics of the quartz glass. An emitting plate 46 may be disposed at an end portion of electrode 32.

A combination of a rare gas and Hg, such as a Penning mixture, is suitable as a filling. A pressure is preferably chosen for the filling which accompanies a minimum breakdown voltage. This filling pressure may be readily ascertained experimentally. A fair approximation can be realized by means of the Paschen curve, as is well known in the art.

According to a preferred embodiment, envelope 30 has an external length of 25 mm, an external diameter of 4 mm, an internal diameter of 3 mm, and a greatest internal length of 15 mm. The electrode 32 has a diameter of 0.5 mm. The UV-enhancer contains Ar with a filling pressure between 5 and 15 torr, preferably 10 torr The insulating member 38 is selected for its insulative properties as well as to minimize interference with the ultraviolet radiation from envelope 30. A significant portion of the envelope 30 is not surrounded by the insulating member 38. Preferably, insulating member 38 is affixed to envelope 30 by a temperature resistant cement 50. It is further contemplated that insulating member 38 may be constructed in other shapes and from other materials.

Conducting member 34 is positioned around insulating member 38, and is conducted to support member 48 by connecting wire 36. In a preferred embodiment, support member 48 is welded to second current conductor 24 at one end, and affixed to insulating member 38 at the other end. Alternatively, wire 36 is directly coupled to second current conductor 24. Conducting member 34 is preferably fabricated from nickelor stainless steel, and preferably measures approximately 0.8 mm in width and 7 mm in diameter.

UV enhancer 28 may serve the purpose of structurally supporting the lamp parts as a bridge member between the current conductors 21 and 25. As described above, a fixed connection is established between the envelope 30, the insulating member 38, and the conducting member 34. The enhancer assembly 28 is subsequently welded to the first and second current conductors, thereby providing additional structural rigidity to the lamp assembly, and thus precluding the need for a separate bridge member, as shown in FIG.1.

A series of UV-enhancers was subjected to an ignition test. The ignitor circuit comprises a Velonex pulse generator. This starter is widely used for testing the ignition of high-pressure discharge lamps and supplies ignition pulses with a range of pulse heights and widths. In this test, a series of 1$\mu$s wide pulses were applied with incrementally increasing pulse height. Once a glow discharge was produced in the UV enhancer, the voltage height was recorded.

The UV-enhancers were provided with a number of position with respect to the frame wire. Each UV-enhancer includes an internal electrode having an emitting plate with a pair of wide surfaces and a pair of narrow surfaces. Positions 1 and 2 were arranged such that the envelope was touching the frame wire. In position 1, the emitting plate 46 within envelope 30 was oriented such that the wide surface was parallel to the frame wire. In position 2, the wide surface of the plate 46 was oriented perpendicular to the wire. For positions 3 and 4, the envelope was spaced approximately 3mm from the frame wire. In position 3, the plate 46 was oriented such that the wide surface was parallel to the frame wire. In position 4, the wide surface of the plate 46 was oriented perpendicular to the wire. In position 5, the envelope 30 was arranged with the conducting member and insulating member as described above according to the present invention.

TABLE 1

| Enhancer | Glow Voltage; position 1 | Glow Voltage; position 2 | Glow Voltage; position 3 | Glow Voltage; position 4 | Glow Voltage; position 5 |
|---|---|---|---|---|---|
| 1 | 3200 | 2880 | 3600 | 3400 | 2000 |
| 2 | 1720 | 1960 | 2760 | 3760 | 1440 |
| 3 | 3900 | 3600 | >4000 | 4000 | 2320 |
| 4 | 3700 | 3200 | >4000 | >4000 | 3600 |
| 5 | 1800 | 1640 | 2000 | 1880 | 960 |
| 6 | 2400 | 1880 | 2920 | 2720 | 2480 |
| 7 | 2960 | 2640 | 3500 | 3300 | 1840 |
| 8 | 2760 | 2440 | 3500 | 3300 | 1600 |
| 9 | 3700 | 3600 | 3700 | 4000 | 2400 |
| 10 | 2160 | 2000 | 2440 | 2440 | 1280 |
| 11 | 3700 | 3600 | 3700 | 4000 | 2400 |
| 12 | 1440 | 1480 | 1840 | 1680 | 720 |
| 13 | 2840 | 2560 | 3700 | 3300 | 2000 |
| 14 | 760 | 760 | 960 | 920 | 1040 |
| Average | 2646 | 2424 | 3066 | 2979 | 1869 |

The test results are illustrated in Table 1. The minimum glow voltages are shown for 14 different enhancer envelopes oriented in positions 1–4 as described above. Position 5 of the envelope in conjunction with the insulating member and conducting member provides increased emission efficiency as indicated by the reduced minimum glow voltage. The tests show a 400–500 V reduction in the voltage required for UV enhancer glow over the conventional UV enhancer mounting.

It will be understood that various modifications may be made to the embodiments shown herein. Therefore, the above description should not be construed as limiting, but merely as exemplifications as preferred embodiments. Those skilled in the art will envision other modifications within the scope and spirit of the claims appended hereto.

What is claimed is:

1. A high-pressure discharge lamp comprising:

a discharge vessel containing an ionizable filling and having first and second electrodes;

a base having first and second terminals;

first and second current conductors electrically coupling said first and second electrodes with said first and second terminals;

an outer bulb enclosing said discharge vessel and defining an intervening space therebetween;

a UV-enhancer positioned in the space between the outer envelope and the discharge vessel, said UV-enhancer comprising an envelope containing an ionizable filling for emitting a ultraviolet radiation, an electrode sealed in said envelope and electrically connected to said first current conductor, a conductive ring electrically connected to said second current conductor and surrounding said envelope; and an insulating sleeve disposed as a spacer between said conducting ring and said envelope.

2. A high pressure discharge lamp as in claim 1 further comprising a support member welded to said second current conductor, said insulating sleeve being fixed to said support member.

3. A high pressure discharge lamp as in claim 2 wherein said conductive ring is electrically connected to said support member.

* * * * *